United States Patent [19]

Davis et al.

[11] Patent Number: 4,805,561

[45] Date of Patent: Feb. 21, 1989

[54] COAL GASIFICATION PROCESS WITH INHIBITION OF QUENCH ZONE PLUGGING

[75] Inventors: D. G. Davis; L. W. R. Dicks, both of Houston, Tex.

[73] Assignee: Shell Oil Company, Houston, Tex.

[21] Appl. No.: 220,421

[22] Filed: Jul. 13, 1988

Related U.S. Application Data

[63] Continuation of Ser. No. 131,606, Dec. 11, 1987, abandoned.

[51] Int. Cl.[4] ..... F22D 1/00

[52] U.S. Cl. ..... 122/7 R; 48/210; 110/229; 122/DIG. 13; 165/133; 165/180

[58] Field of Search ..... 122/7 R, DIG. 13, 235 C; 110/229; 48/210, 77, 101; 165/180, 133

[56] References Cited

U.S. PATENT DOCUMENTS

| | | | |
|---|---|---|---|
| 4,022,591 | 5/1977 | Staudinger | 48/76 |
| 4,350,103 | 9/1982 | Poll | 110/264 |
| 4,402,764 | 9/1983 | Clark et al. | 427/255 X |
| 4,458,607 | 7/1984 | Schoeber et al. | 110/347 |
| 4,501,777 | 2/1985 | Rose | 427/255 |
| 4,550,769 | 11/1985 | Bhojwani et al. | 122/7 R X |
| 4,644,907 | 2/1987 | Hunter | 122/DIG. 13 |

FOREIGN PATENT DOCUMENTS 1501284 2/1978 United Kingdom .

OTHER PUBLICATIONS

*Coal Gasifier Wall Protection System;* Nyserda 80-5; Marshall; Apr. 1980.

*Coal Gasifier Wall Protection System Slag Shedding Technique;* ERDA Report 82-36, Marshall et al., Dec. 1982.

*Primary Examiner*—Edward G. Favors

[57] ABSTRACT

A process for the gasification of coal to product synthesis gas is disclosed, the process being characterized by passage of product gas stream containing sticky or molten particles upward from the gasification zone and quenching of the product gas stream and particles in a quench zone coated or lined internally with titanium diboride.

3 Claims, 1 Drawing Sheet

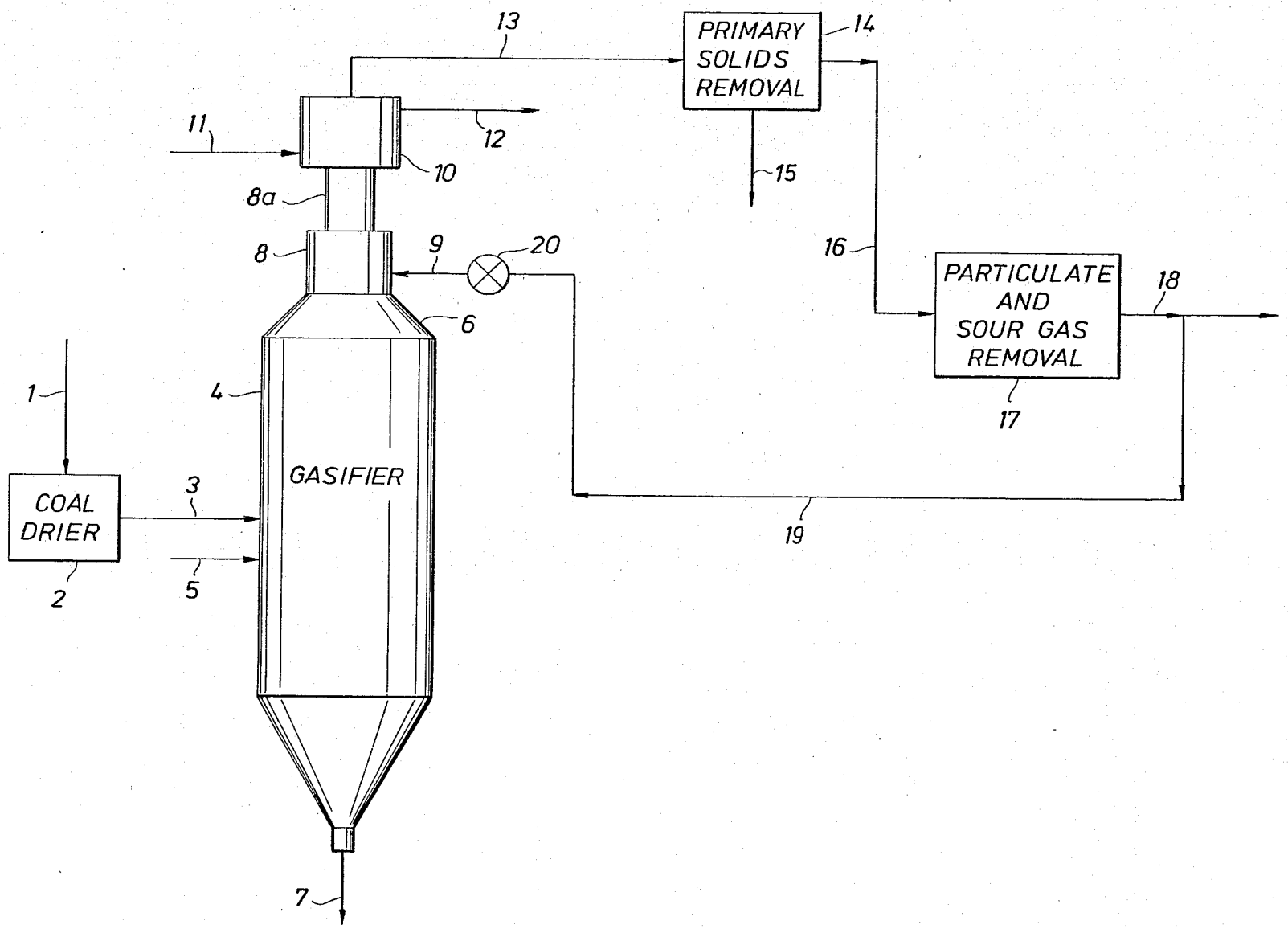
PARTICULATE AND SOUR GAS REMOVAL
PRIMARY SOLIDS REMOVAL
GASIFIER
COAL DRIER
1
2
3
4
5
6
7
8
8a
9
10
11
12
13
14
15
16
17
18
19
20

COAL GASIFICATION PROCESS WITH INHIBITION OF QUENCH ZONE PLUGGING

This is a continuation of application Ser. No. 131,606 filed Dec. 11, 1987 abandoned.

BACKGROUND OF THE INVENTION

Partial combustion or gasification of coal involves reaction of the coal at elevated temperatures, and possibly elevated pressures, with a limited volume of oxygen, the reaction preferably being carried out in a reactor or reaction chamber or vessel by means of "burners" in the presence of additional agents such as steam, carbon dioxide, or various other materials. Gasification of coal produces a gas, known as synthesis gas, that contains mostly carbon monoxide and hydrogen. Also produced are varying minor quantities of other gases, such as carbon dioxide and methane, and, at least with some coals, various heavier materials, such as small sticky or molten particles. In some processes, the design of the gasifier or reactor is such that the sticky or molten particles are carried downward principally by the synthesis gas through a water quench area or zone, and thence to a slag recovery area. Remaining fine particles, now solidified, pass with the synthesis gas from the bottom of the quench zone to cyclones, where the particles are separated.

In at least one other coal gasification process undergoing development, the design of the gasifier is such that a rough separation of the molten particles takes place in the gasifier vessel or chamber. That is, the heavy particles drop to the bottom of the gasifier vessel to a slag recovery area or bath, and lighter and molten particles are carried by the synthesis gas upward and out of the reactor chamber into a quench zone which is mounted generally above the gasifier, and wherein a cool quench gas is employed to quench the gas and particles. The particles carried upward, in the aggregate, tend to be of somewhat different chemical composition than the "slag" which falls to the bottom of the vessel, and are designated collectively herein as "flyslag." The solidified material, because it is derived from a "reducing" atmosphere, may be different in composition and properties from flyash normally associated with combustion boilers, wherein a fully oxidizing atmosphere is utilized. For example, the flyslag from processes for partial combustion of coal may contain elemental iron and sulphides, components not normally associated with boiler flyash.

A significant concern in processes where the molten or sticky particles are transported up into the quench zone is the possibility that the flyslag particles will stick to the walls of the quench zone. Unlike the down-fired processes, where water may be present or injected to quench and help wash down the particles, a quench gas, such as a cool recycle gas, may be employed, along with indirect heat exchange, for quenching and cooling the synthesis gas and the sticky or molten particles. Sticking of the flyslag particles will cause loss of heat transfer, and, of greatest concern, possibly result in plugging of the quench zone. The invention addresses this problem.

SUMMARY OF THE INVENTION

Accordingly, the invention relates to a process for the gasification of coal in which particulate coal is partially oxidized in a gasification zone or gasifier, producing a hot synthesis gas containing sticky or molten flyslag particles. The hot synthesis gas containing the sticky or molten flyslag particles is then passed upward from the gasification zone to a quench zone where the gas is quenched, and the particles are solidified, the quench zone comprising an indirect heat exchange zone, the heat transfer surfaces of which indirect heat exchange zone in contact with the hot synthesis gas and through which heat is extracted from the hot gas to a coolant at least partly being composed of titanium diboride.

As used herein, the terms "surface" or "surfaces", in referring to the material in contact with the hot synthesis gas and the sticky or molten flyslag particles, refer either to a coating of the titanium diboride on the quench zone heat exchanger wall or walls, or to a liner of titanium diboride positioned between the synthesis gas and the flyslag and heat exchanger wall or walls (or tubes). The coating or liner may be fabricated according to techniques known to those skilled in the art. Coatings have the advantage that they may be readily applied to the walls of the exchanger, such as by spraying, vacuum application, or brushing, e.g., in the form of a dispersion, and may be applied in layers, while a liner will generally require fabrication offsite, hanging mechanism(s), and insertion in place. On the other hand, a liner may be fabricated with grooves or channels, for heat exchange fluids, such as steam, and may tend to last longer because of its greater thickness. In general, coatings will normally be applied in a thickness of up to 30 mils or so, preferably from 10 to 12 mils, while liners may range up to ¼ to ½ inch, or even more, in thickness. In both cases, consideration must be taken of differences in the coefficients of expansion of the titanium diboride coating or liner and the quench zone heat exchanger wall or walls. In the case of a coating, a pre-coating of the wall or walls with another material which absorbs some of the expansion differences or which enhances bonding may be employed, or the dispersion of the silicon nitride may be formulated to provide some "flex", as understood by those skilled in the art. In the case of a liner, provision may be made in the mounting of the liner, and/or a coolant may be circulated in channels of the liner to regulate expansion. It is not necessary that all of the quench zone be coated or lined with titanium diboride; preferably, however, at least the lower half of the vertically disposed zone is coated or lined.

Preferably, the temperature of the surface of the titanium diboride in contact with the hot synthesis gas and the flyslag should be below a certain temperature or temperature range. If the surface of the titanium diboride is above a certain temperature or temperature range, a tendency for some particles to stick and accumulate may arise. The invention has the advantage that even if the temperature of the liner or coating is such that there is a tendency to stick, the "non-stick" character of the titanium diboride coating or liner inhibits sticking. As used herein, the term "temperature at which particles tend to stick" is a range of temperatures, and will vary from coal to coal, depending on the composition of the matter which forms the particles. Accordingly, a precise number or range cannot be given, but simple testing will determine this temperature or range. For example, a testing procedure analogous to that described in the New York State Energy Research and Development Report 82-36 (12-1982) may be employed. In the case of most coals, particles may tend to stick at a titanium diboride surface temperature (in contact with the gas and particles) which is above about 500° C.

After the starting materials have been converted, the reaction product, which has a temperature of between about 1050° C. and about 1800° C., and which comprises hydrogen, carbon monoxide, carbon dioxide, and water, as well as the aforementioned impurities, is passed upward from the reactor. As will be evident, passing the hot synthesis-gas containing sticky particles upward from the reactor provides a separation of the synthesis gas and the particles, so that, in some instances, this separation, along with rapid quench and/or cooling, is sufficient to prevent deposition of the particles. In other cases, however, the sticky particles represent the problem mentioned, and the particles must be taken into account. By use of a coating or liner of titanium diboride, as specified, with an appropriate liner temperature, the particles will proceed upward without sticking, or will fall back into the gasifier. The upward moving particles will then be solidified by the quench gas and indirect heat exchange, and the synthesis gas stream with solidified particles then passes on for further cooling and treatment. As indicated, a variety of elaborate techniques have been developed for quenching and cooling the gaseous stream, the techniques in the quench zone and primary heat exchange zone in general being characterized by the use of a quench gas and a boiler in which steam is generated with the aid of the waste heat. The walls of the quench zone, i.e., the external or wall surfaces not in contact with the synthesis gas, and those of the primary heat exchange zone, are cooled with boiling water or steam.

DETAILED DESCRIPTION OF THE INVENTION

The partial combustion of coal to produce synthesis gas, which is substantially carbon monoxide and hydrogen, and particulate flyslag, is well known, and a survey of known processes is given in "Ullmanns Enzyklopadie Der Technischen Chemie", vol. 10 (1958), pp. 360–458. Several such processes for the preparation of hydrogen and carbon monoxide, flyslag gases are currently being developed. Accordingly, details of the gasification process are related only insofar as is necessary for understanding of the present invention.

In general, the gasification is carried out by partially combusting the coal with a limited volume of oxygen at a temperature normally between about 1050° C. and about 2000° C. If a temperature of between 1050° C. and 2000° C. is employed, the product gas may contain very small amounts of side products such as tars, phenols and condensable hydrocarbons, as well as the molten or sticky particles mentioned. Suitable coals include lignite, bituminous coal, sub-bituminous coal, anthracite coal, and brown coal. In order to achieve a more rapid and complete gasification, initial pulverization of the coal is preferred. Particle size is preferably selected so that 70% of the solid coal feed can pass a 200 mesh sieve. The gasification is preferably carried out in the presence of oxygen and steam, the purity of the oxygen preferably being at least 90% by volume, nitrogen, carbon dioxide and argon being permissible as impurities. If the water content of the coal is too high, the coal should be dried before use. The atmosphere will be maintained reducing by the regulation of the weight ratio of the oxygen to moisture and ash free coal in the range of 0.6 to 1.0, preferably 0.8 to 0.9. The specific details of the equipment and procedures employed form no part of the invention, but those described in U.S. Pat. Nos. 4,350,103, and 4,458,607, both incorporated herein by reference, may be employed. Although, in general, it is preferred that the ratio between oxygen and steam be selected so that from 0.1 to 1.0 parts by volume of steam is present per part by volume of oxygen, the invention is applicable to processes having substantially different ratios of oxygen to steam. The oxygen used is preferably heated before being contacted with the coal, preferably to a temperature of from about 200° C. to 500° C.

The details of the gasification reactor system form no part of the present invention, and suitable reactors are described in British Pat. No. 1501284 and U.S. Pat. No. 4,022,591. The high temperature at which the gasification is carried out is obtained by reacting the coal with oxygen and steam in a reactor at high velocity. A preferred linear velocity is from 10 to 100 meters per second, although higher or lower velocities may be employed. The pressure at which the gasification can be effected may vary between wide limits, preferably being from 1 to 200 bar. Residence times may vary widely; common residence times of from 0.2 to 20 seconds are described, with residence times of from 0.5 to 15 seconds being preferred.

In order to illustrate the invention more fully, reference is made to the accompanying schematic drawing. The drawing is of the process flow type in which auxiliary equipment, such as valves, pumps, holding vessels, etc., have been omitted therefrom. All values are merely exemplary or calculated.

Accordingly, pulverulent coal is passed via line (1) into a coal dryer (2) where the coal is dried, suitably at a temperature of about 200° C. The dry coal is subsequently discharged through a line (3) and passed into a gasification reactor (4) where it is gasified at a temperature of about 1500° C. to about 2000° C., a pressure of about 35 atmospheres absolute, with oxygen, which is supplied through a line (5). The gasification produces a product or synthesis gas containing sticky molten particles which is removed from the upper portion (6) of the reactor, and a slag which is removed from the lower portion of the reactor via line (7). The gasification product is passed upward via conduit or quench zone (8) where it is quenched by cooled synthesis gas supplied via line (9) and indirect heat exchange with steam, and is then passed via duct 8(*a*) through a boiler or heat exchange zone (10) where it is cooled to a temperature of about 200° C. The walls and tubes of quench zone (8) in contact with the synthesis gas are coated with titanium diboride. In the heat exchange zone (10), water, which is supplied through line (11), is converted by indirect heat exchange to high pressure steam, the steam being discharged through a line (12). The cooled gasification product is passed through a line (13) to a series of cyclones (14) where the bulk of the particulates (flyslag) is removed and sent via line (15) to storage. The synthesis gas then passes via line (16) to a series of purification steps designated as (17) where a final, cooled product synthesis gas is removed via line (18). A portion of the cooled gas is recycled via line (19) to quench zone (8) for quenching the hot gas from reactor (4). A partially cooled, impure gas is removed and utilized (not shown).

While the invention has been illustrated with particular apparatus, those skilled in the art will appreciate that, except where specified, other equivalent or analogous units may be employed. The term "zone", as employed in the specification and claims, includes, where suitable, the use of segmented equipment operated in series, or the division of one unit into multiple units to improve efficiency or overcome size constraints, etc. For example, a series of scrubbers might be employed, with different aqueous solutions, at least the bulk of the "loaded" solutions being sent to one or more strippers. Parallel operation of units is, of course, well within the scope of the invention.

What is claimed is:

1. A process for the gasification of coal comprising oxidizing coal under conditions to produce hot synthesis gas containing flyslag and having a temperature of from about 1050° C. to about 1800° C.;

passing the hot synthesis gas containing flyslag upward from the gasification zone and quenching the synthesis gas and flyslag in a quench zone, the quench zone comprising an indirect heat exchange zone, the heat transfer surfaces of said indirect heat exchange zone in contact with said hot synthesis gas and flyslag and through which heat is extracted from the hot gas to a coolant at least partly being composed of titanium diboride.

2. The process of claim 1 wherein the heat transfer surface of the indirect heat exchange zone in contact with the hot synthesis gas and flyslag comprises at least partly a coating of titanium diboride.

3. The process of claim 1 wherein the heat transfer surface of the indirect heat exchange zone in contact with the hot synthesis gas and flyslag comprises at least partly a liner of titanium diboride.

* * * * *